United States Patent [19]

O'Lenick, Jr. et al.

[11] Patent Number: 4,804,483

[45] Date of Patent: Feb. 14, 1989

[54] CATIONIC SOIL RELEASE POLYMERS

[75] Inventors: Anthony J. O'Lenick, Jr., Lilburn; Joseph J. Fanelli, Alpharetta, both of Ga.

[73] Assignee: GAF Corporation, Wayne, N.J.

[21] Appl. No.: 144,482

[22] Filed: Jan. 13, 1988

Related U.S. Application Data

[63] Continuation of Ser. No. 54,028, May 26, 1987, Pat. No. 4,738,787.

[51] Int. Cl.[4] ..... D06M 13/46

[52] U.S. Cl. ..... 252/8.8; 252/8.7; 252/8.75; 252/547; 252/174.21; 252/174.22; 252/174.23; 8/115.64; 8/115.65; 8/115.66; 8/127.51; 8/188; 560/12; 560/81; 560/83; 560/88; 528/170; 528/171; 528/211; 548/349; 548/354; 260/501.13

[58] Field of Search ..... 252/8.8, 8.75, 547, 252/528, 174.21, 174.23, 8.7, 174.22; 8/188, 127.51, 115.65, 115.64, 115.66; 560/12, 42, 44, 88, 83, 81; 260/501.13; 548/349, 354; 528/170, 171, 211

[56] References Cited

U.S. PATENT DOCUMENTS

| | | | |
|---|---|---|---|
| 3,212,873 | 10/1965 | Richter | 71/2.6 |
| 3,416,952 | 12/1968 | McIntyre | 117/118 |
| 3,557,039 | 1/1971 | McIntyre et al. | 260/29.2 |
| 3,875,111 | 4/1975 | Tasuda et al. | 528/211 |
| 3,893,929 | 7/1975 | Basadur | 252/8.6 |
| 3,904,359 | 9/1975 | Ramachandran | 252/8.6 |
| 3,959,230 | 5/1976 | Hays | 260/75 R |
| 3,962,152 | 6/1976 | Nichol et al. | 252/551 |
| 3,979,306 | 9/1976 | Arai et al. | 252/8.6 |
| 4,000,077 | 12/1976 | Wixon | 252/8.75 |
| 4,038,294 | 7/1977 | Conner et al. | 260/404.5 |
| 4,045,358 | 8/1977 | Ramachandran | 252/8.6 |
| 4,075,735 | 2/1978 | Ramachandran | 252/8.8 |
| 4,089,786 | 5/1978 | Ciko et al. | 252/8.8 |
| 4,094,796 | 6/1978 | Schwarz | 252/8.8 |
| 4,116,885 | 9/1978 | Derstadt et al. | 252/532 |
| 4,132,680 | 1/1979 | Nicol | 252/547 |
| 4,134,839 | 1/1979 | Marshall | 252/8.6 |
| 4,134,840 | 1/1979 | Minegishi et al. | 252/8.9 |
| 4,144,177 | 3/1979 | Minegishi et al. | 252/8.8 |
| 4,201,824 | 5/1980 | Violland et al. | 428/262 |
| 4,210,417 | 7/1980 | McClain et al. | 8/137 |
| 4,222,905 | 9/1980 | Cockrell, Jr. | 252/547 |
| 4,247,476 | 1/1981 | Haase et al. | 560/88 |
| 4,349,688 | 9/1982 | Sandler | 560/91 |
| 4,375,540 | 3/1983 | Joyner et al. | 528/302 |
| 4,384,130 | 5/1983 | Martin | 556/418 |
| 4,427,557 | 1/1984 | Stockburger | 252/8.7 |
| 4,730,079 | 3/1988 | Hofinger et al. | 560/88 |

FOREIGN PATENT DOCUMENTS

| | | |
|---|---|---|
| 1317278 | 5/1973 | United Kingdom . |

*Primary Examiner*—A. Lionel Clingman
*Assistant Examiner*—Hoa Van Le
*Attorney, Agent, or Firm*—Marilyn J. Maue; Joshua J. Ward

[57] ABSTRACT

The present application relates to cationic block polyesters useful as soil release agents, softeners and antistatic agents. In addition to cleaning performance, laundry detergent compositions should have other benefits. One is the ability to impart soil release properties to fabrics woven from polyester fibers.

15 Claims, No Drawings

CATIONIC SOIL RELEASE POLYMERS

This is a continuation of co-pending application Ser. No. 07/054,028 filed on May 26, 1987, now U.S. Pat. No. 4,738,787.

FIELD OF INVENTION

The present application relates to cationic block polyesters useful as soil release agents, softeners and antistatic agents. In addition to cleaning performance, laundry detergent compositions should have other benefits. One is the ability to impart soil release properties to fabrics woven from polyester fibers. These fabrics are predominantly co-polymers of ethylene glycol and terephthalic acid, and are sold under a number of trade names, e.g., Dacron, Fortrel, Kodel and Blue C Polyester. The hydrophobic character of polyester fabrics makes their laundering difficult, particularly with oily soil and oily stains. The oily soil or stain preferentially "wets" the fabric. As a result, the oily soil or stain is difficult to remove in an aqueous laundering process.

BACKGROUND OF THE INVENTION

Products which have been used for their soil release and antistatic properties can be divided into several classes based upon the chemistry of the products.

Polyesters containing random ethylene terephthalate/polyethylene glycol (PEG) terephthalate units High molecular weight (e.g., 40,000 to 50,000 M.W.) polyesters containing random ethylene terephthalate/-polyethylene glycol (PEG) terephthalate units have been used as soil release compounds in laundry detergent compositions (U.S. Pat. No. 3,962,152 to Nicol et al, issued June 8, 1976). During the laundering operation, these soil release polyesters adsorb onto the surface of fabrics immersed in the wash solution. The adsorbed polyester then forms a hydrophilic film which remains on the fabric after it is removed from the wash solution and dried. This film can be renewed by subsequent washing of the fabric with a detergent composition containing the soil release polyesters.

These ethylene terephthalate/polyethylene glycol terephthalate polyesters are not water-soluble. It is believed that they form a suspension in the wash solution which does not adsorb efficiently onto the fabrics. As a result, the level of soil release polyester in the detergent composition has to be increased if benefits are to be obtained after several wash cycles. Because of this poor water-solubility, these polyesters are formulated as suspensions in laundry detergent compositions, rather than as isotropic liquids. In certain detergent formulations, these polyesters can also diminish clay soil cleaning performance.

Polyester antistatic agents formed from dimethyl terephthalate, ethylene glycol and methoxy PEGs U.S. Pat. No. 3,416,952 to McIntyre et al., issued Dec. 17, 1968, discloses the treatment of shaped polyester articles with a water-insoluble crystallizable polymeric compound which can contain a water soluble polymeric group such as a polyoxyalkylene group having an average molecular weight of from 300–6000. Preferred polyoxyalkylene groups are the polyethylene glycols having an average molecular weight of from 1000–4000. Treatment of the shaped articles is carried out by applying an aqueous dispersion of the crystallizable polymeric compound in the presence of an anti-oxidant, followed by heating to a temperature above 90 degrees C. to obtain a durable coating of the compound on the shaped article. One such crystallizable polymeric compound is formed by the reaction of dimethyl terephthalate, ethylene glycol and an O-methyl poly-(oxyethylene) glycol of average molecular weight 350. A 20% solution of this polyester in benzyl alcohol was used to impart antistatic properties to a polyester fabric. The patent also discloses a 20% aqueous solution of a similar polyester used to impart antistatic properties to a polyester fabric.

Polyester antistatic and soil release agents formed from dimethyl terephthalate, sodium dimethyl-5-sulphoisophthalate, ethylene glycol and polyethylene glycol (PEG)

U.S. Pat. No. 4,427,557 to Stockburger, Jan. 24, 1984, discloses low molecular weight copolyesters (M.W. 2,000 to 10,000) which can be used in aqueous dispersions to impart soil release properties to polyester fibers. The copolyesters are formed by the reaction of ethylene glycol, a polyethylene glycol having an average molecular weight of 200 to 1000, an aromatic dicarboxylic acid (e.g., dimethyl terephthalate), and a sulfonated aromatic dicarboxylic acid (e.g., dimethyl 5-sulfoisophthalate). The polyethylene glycol can be replaced in part with monoalkylethers of polyethylene glycol such as the methyl, ethyl and butyl ethers. A dispersion or solution of the copolyester is applied to the textile material and then heat set at elevated temperatures (90 degrees to 150 degrees C.) to impart durable soil release properties.

Monomeric polyesters of polyethylene glycol and terephthalic acid useful as soil release agents U.S. Pat. No. 4,349,688 to Sandler, issued Sept. 14, 1982, discloses polyoxyalkylene ester soil release agents, in particular monomeric polyesters of polyethylene glycol and terephthalic acid having the formula:

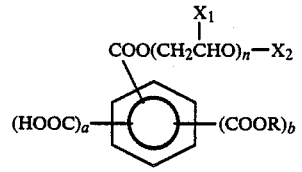

where a can be 1 or 2, b can be 0 or 1, n can range from 6–23 and X is either a methyl group or Hydrogen. Additionally the preparation of one such polyethylene glycol/terephthalate polyester formed from terephthaloyl chloride and Carbowax 400 (n=9, x=H) is disclosed. Durable soil resistance and water wicking properties are imparted by wetting the fabric with a composition containing the polyoxyalkylene ester, drying the wetted fabric, and then curing the dried fabric at a temperature of from 190–200 degrees C. for about 45–90 seconds.

Ethylene terephthalate/PEG terephthalate soil release polyesters for fabric treating solutions U.S. Pat. No. 3,959,230 to Hays, issued May 25, 1976, discloses polyester soil release agents containing random ethylene terepthalate/polyethylene glycol terephthalate units in a mole ratio of from about 25:75 to about 35:65. These soil release polyesters have a molecular weight of from about 25,000 to about 55,000, (preferably from about 40,000 to about 55,000) and are used in dilute, aqueous solutions, preferably with an emulsifying agent present. Fabrics are immersed in this solution so that the soil release polyester adsorbs onto the fabric surface. The polyester forms a hydrophilic film which remains on the fibers after the fabric is removed from the solution and dried. See also U.S. Pat. No. 3,893,929 to Basadur, issued July 8, 1975 (compositions for imparting soil release finish containing a polyester having an average molecular weight of 3000–5000 formed from terephthalic acid, polyethylene glycol and ethylene glycol); U.S. Pat. No. 3,712,873 to Zenk, issued Jan. 23, 1973 (textile treating composition comprising fatty alcohol polyethoxylates; quaternary ammonium compounds; a polyester having average molecular weight of 3000–5000 formed from terephthalic acid, polyethylene glycol and ethylene glycol; and starch).

Ethylene terephthalate/PEG terephthalate soil release agents used in detergent compositions U.S. Pat. No. 3,962,152 to Nicol et al., issued June 8, 1976, discloses detergent compositions containing detergent surfactants and the ethylene terephthalate/-polyethylene glycol terephthalate soil release polyesters disclosed in U.S. Pat. No. 3,959,230 issued to Hays. Additionally U.S. Pat. No. 4,116,885 to Derstadt et al., issued Sept. 26, 1978 (detergent compositions containing certain compatible anionic detergent surfactants and ethylene terephthalic/polyethylene glycol terephthalate soil release polyesters); U.S. Pat. No. 4,132,680 to Nicol, issued Jan. 2, 1979 (detergent compositions containing detergent surfactants; a composition which disassociates to yield quaternary ammonium cations; and an ethylene terephthalate/polyethylene glycol terephthalate soil release polyester) are of interest.

Soil release and antistatic polyurethanes useful in detergent compositions which contain polyester blocks having sulfoisophthalate units U.S. Pat. No. 4,201,824 to Violland et al., issued May 6, 1980, discloses hydrophilic polyurethanes having soil release and antistatic properties useful in detergent compositions. These polyurethanes are formed from the reaction product of a base polyester with an isocyanate prepolymer (reaction product of diisocyanate and macrodiol). Further, a disclosure is made regarding base polyester formed from dimethyl terephthalate, dimethyl sulfoisophthalate, ethylene glycol and polyethylene glycol (molecular weight 300) which is reacted with a prepolymer formed from a polyethylene glycol (molecular weight 1,500) and toluene diisocyanate.

The previously mentioned patents, included by reference, describe a number of ways that one can make polymeric materials which are substantive to fiber. This substantivity renders the fiber soil resistant.

One shortcoming of these polyester type polymers used as soil release materials is that the benefits of softening and hand modification desired by the consumer are not realized. Softeners are typically formulated into detergents or added in a post step as a rinse cycle softener.

Additionally, U.S. Pat. No. 4,134,839 to Marshall discloses the use of an alkanolamide reacted with a polycarboxybenzene ester to give a soil release polymer.

U.S. Pat. No. 4,375,540 to Joyner discloses copolyester derivatives from aromatic dibasic acid and aliphatic dibasic acids of glycol.

U.S. Pat. No. 4,310,426 to Smitz discloses a yellowing resistant soil release agent.

U.S. Pat. No. 4,094,796 to Schwarz discloses a novel polyoxyalkylene polymeric.

The fomer materials, while rendering soil release properties to the treated fabric, do not give the desired softening properties. Softeners generally are added in addition to the soil release agent and are often added in a subsequent step. Commonly used fabric softeners are quaternary compounds which are prepared by quaternization of a tertiary amine with such agents as benzyl chloride or dimethyl sulfate or diethyl sulfate or methyl chloride. These materials are relatively inexpensive but offer several key disadvantages including yellowing of fabric, a tendency to build up upon repeated treatment, and variability in hand (ie. softness and feel). Few if any molecules have all the desirable properties. Standard softeners used are selected from the following classes:

Class #1. Alkyl Imidazoline Quaternaries made from the quaternization of an imidazoline made by reacting Diethylenetriamine, and a high molecular weight acid like stearic. The standard quaternizating agents are selected from diethyl sulfate, methyl chloride, dimethyl sulfate, methyl chloride or benzyl chloride.

Class #2. Alkyl or dialkyl tertiary amines quaternized with one of the following; benzyl chloride, diethyl sulfate, methyl chloride or dimethyl sulfate Class #3. Quaternaries of ethoxylated, propoxylated or non-alkoxylated amido amines derived from the reaction of a high molecular weight acid like stearic and a multi amine like Diethylenetriamine. The standard quaternizating agents are diethyl sulfate or dimethyl sulfate or methyl chloride or benzyl chloride.

Class #4. Amido-amine salts derived from partially acid neutralized amines.

U.S. Pat. No. 4,038,294 to Conners and Fogel describes a fatty halo alkanoate quaternary. This patent does not make use of polymeric materials and is not aimed at soil release agents.

As mentioned some of the standard cationic fabric softeners have a marked tendency to impart yellowness to fabrics at elevated temperatures, especially when the cationic is applied repeatedly, U.S. Pat. No. 3,904,359 assigned to Colgate Palmolive describes a method of minimizing yellowness in fabrics by treating the fabric softening quaternary with a complexing acid, including citric, fumaric, adipic, succinic or mixtures thereof. The addition of these acids forms salts with residual amine compounds present as un-reacted raw materials in the preparation of the quaternary. Additionally, U.S. Pat. No. 4,073,735 to Ramachandran issued Feb. 14, 1978 and U.S. Pat. No. 4,045,358 to Ramachandran issued Aug. 30, 1977, teach that addition of alkali metal silicates or perphthalic acid is also effective in minimizing yellowness. The same phenomenon is believed to occur, namely the formation of salts with residual amine compounds present as un-reacted raw materials in the preparation of the amine. Addition of higher alcohol sulfates is also presented in U.S. Pat. No. 4,000,077 to Wixon issued Dec. 8, 1976. The addition of antioxidants like 4,4'-butylidenebis-(6-tert-butyl-3-methylphenol) is disclosed in U.S. Pat. No. 3,979,306. Another approach to non-yellowing softeners is to use expensive amphoterics. This is disclosed in U.S. Pat. No. 4,089,786 to Ciko issued May 16, 1978. Minegishi et al describes in U.S.

Pat. No. 4,144,177 issued Mar. 13, 1976, the use of dialkyl quaternary compounds for improved softening when applied to synthetic blends. He also teaches in U.S. Pat. No. 4,134,840 that ether carboxylates can be added to improve softening of synthetic blends. The additions described above are palliative and do not address the basic problem intrinsic to the molecule. Distearyl dimethyl ammonium chloride is much better in preventing yellowing, but is not substantive to the substrate after one wash.

Percentages and ratios used herein are by weight, unless otherwise noted. References cited herein are incorporated by reference.

STATEMENT OF THE INVENTION

It is the objective of this invention to provide both soil release and softening as well as antistatic properties to fabrics, paper and hair. More specifically, the present invention is directed to the preparation and application of a polyoxyalkylene ester quaternary.

DETAILED DESCRIPTION OF THE INVENTION

The quaternary is desirably prepared by the reaction of an aromatic hydroxy containing polyester soil release agent with monochloracetic acid to produce an ester intermediate then using that halogen containing ester to make a quaternary.

The quaternaries of the invention conform to the following generic structure;

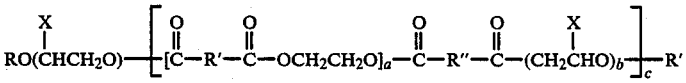

wherein

R and R′ may be the same or different and are selected from;

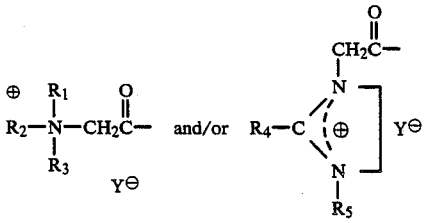

an example of an imidazoline heterocycle

R or R′ may additionally be selected from H, or alkyl $C_1$ to $C_{20}$, saturated or unsaturated, aliphatic or aromatic, with the proviso that both R and R′ are not selected from H, or alkyl $C_1$ to $C_{20}$, saturated or unsaturated, aliphatic or aromatic.

R″ is

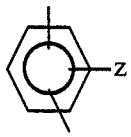

Z is —$SO_3Na$, H, COOH, $COO^{\ominus}$

X is H, $CH_3$, or $CH_2CH_3$ or any combination

Y is Cl or Br needed for charge balance.

a is an integer from 1–5 b is an integer from 1–200 c is an integer from 1–50

$R_1$ $R_2$ $R_3$ may be the same or different and are selected from $C_1$ to $C_{22}$ aliphatic or aromatic, saturated or unsaturated, linear or branched or alkylamidopropyl.

$R_4$ is $C_7$ to $C_{21}$ alkyl $R_5$ is;

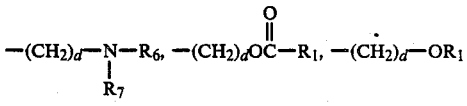

$R_6$ is H,

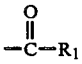

$R_7$ is H,

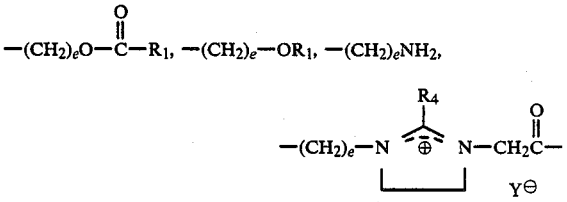

d is an integer from 1–3 e is an integer from 0–3

The quaternary compounds of this invention can be formulated into softeners that are applied directly in aqueous solution by themselves or formulated with anionics and builders to prepare finished conditioner/detergent systems. The quaternaries are also useful in cellulose debonding, particularly in combination with water in a weight ratio of the quaternary to the water of between 1:99 to about 75:25

Yellowing on Textiles

Compounds of this invention were compared to standard compounds commercially available using AATCC Test Method 117–1979. The color fastness heat test uses a 200° C. (400° F.) hot iron which is applied for 60 and 180 seconds. The color is rated on a 1–5 basis for yellowness, (5 being the most yellow).

| Compound | CAS Number | Yellowness |
|---|---|---|
| Class #1 Compound | 68122-86-1 | 4 |
| Class #2 Compound | 61789-81-9 | 4 |
| Class #3 Compound | 65098-88-6 | 5 |
| Class #4 Compound | 68308-45-2 | 4 |
| Distearyl-dimethyl-ammonium chloride | 107-64-2 | 2 |
| Developmental Product #1 | Example #8 | 1 |
| Developmental Product #2 | Example #11 | 2 |

The raw materials used to prepare the compounds of the invention include but are not limited to Milease T, Alkaril QC-J (Cas #9016-88-0) and Milease HPA (Cas #8852-78-6). The raw materials useful in the preparation of products of this invention conform to the following generic formulae;

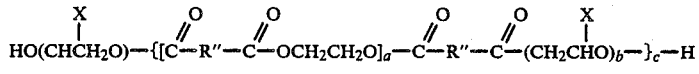

1.

R'' is

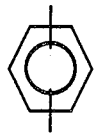

X is H
a is an integer from 1–5
b is an integer from 1–200
c is an integer from 1–50

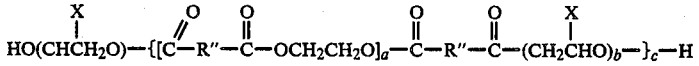

2.

R'' is a mixture of

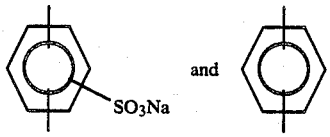

X is H and/or $CH_3$
a is an integer from 1–5
b is an integer from 1–200
c is an integer from 1–50

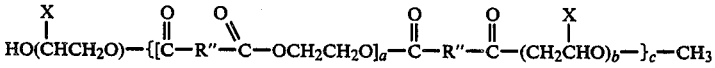

3.

R'' is

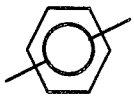

a is an integer from 1–5
b is an integer from 1–200
c is an integer from 1–50
X is H and/or $CH_3$

RAW MATERIAL EXAMPLES

Illustrative of the preparation of this class of products is the following;

Raw Material Example 1

U.S. Pat. No. 3,557,039 teaches that dimethyl terephthalate (53.7 parts) dimethyl sodium sulfosophthalate (9.1 parts) ethylene glycol (43 parts) calcium acetate hemihydrate (0.049 parts) and antimony trioxide (0.025 parts) were mixed together and heated until the theoretical amount of methanol is removed. Phosphorous acid is added (0.09 parts) and the excess glycol distilled off under vacuum at 290 degrees C.

Raw Material Example 2

U.K. Pat. No. 1,317,278 teaches spinning grade poly-(ethylene terephthalate) (134.4 parts), polyethylene glycol of nominal molecular weight 1540 (308 parts) and antimony trioxide (0.0022 part) were charged to a 4-necked flask with a scaled bottom runoff tube and fitted with a stirrer, internal thermometer, nitrogen inlet and a condenser set for distillation. The flask was heated in an electric mantle through which the bottom runoff tube protruded. The temperature of the contents of the flask was raised to 260 degrees plus/minus 5 degrees C. over half an hour and held at 260 degrees C. plus/minus 5 degrees C. for three hours.

Raw Material Example 3

Spinning grade poly-(ethylene terephthalate) (134.4 parts) the a 1:1 EO;PO block polymer having a molecular weight of about 1540 (308 parts) and antimony trioxide (0.0022 part) were charged to a 4-necked flask with a scaled bottom runoff tube and fitted with a stirrer, internal thermometer, nitrogen inlet and a condenser set for distillation. The flask was heated in an electric mantle through which the bottom runoff tube protruded. The temperature of the contents of the flask was raised to 260 degrees plus/minus 5 degrees C. over half an hour and held at 260 degrees C. plus/minus 5 C.

Raw Material Example 4

U.S. Pat. No. 4,349,688 teaches that 105 parts of trimellitic monoacid chloride and 175 parts of methoxy capped polyoxethylene (molecular weight 350) are mixed together and heated to 110–130 degrees C. until the theoretical amount of hydrogen chloride gas is removed. Subsequently, 200 parts of polyoxethylene (molecular weight 400) is added and the temperature is held at 110–130 degrees C. until the anhydride absorbtion band at 5.65 microns becomes vanishingly small.

Raw Material Example 5

U.S. Pat. No. 3,416,952 teaches that 194 parts of dimethyl terephthalate, 64 parts of ethylene glycol, 1000 parts of methoxy capped polyoxethylene (molecular weight 350), and 0.6 parts of antimony trioxide are added together and heated to 210–220 degrees C. This temperature is maintained until the theoretical amount of distillate is removed.

EXAMPLES

The preparation of the quaternaries of this invention takes place in two steps. First an ester of monochloroacetic acid or a related compound is made. Subsequently, that halogen containing ester is used to make the quaternary using a suitable amine. The amine can be primary, secondary or tertiary. The number of equivalents needed to make the quaternary then would be three two and one respectively.

PREPARATION OF THE ORGANO-HALOGEN ESTER

Example 1

To 952.0 grams of Alkaril's Base C (Cas #9016-88-0) having a hydroxyl value of approximately 25 mg KOH/gram add 36.1 grams of monochloroacetic acid, and 1.0 grams of paratoluene sulfonic acid. Heat to 120–150 degrees C. using a nitrogen sparge. Water will begin to distill off once the temperature reaches 120 degrees C. Once 98% of the theoretical water level is reached proceed into step two-reaction with suitable amines.

Example 2

To 1190.0 grams of ICI's Milease T 100% active having a hydroxyl value of approximately 20 mg KOH/gram add 36.1 grams of monochloroacetic acid, and 1.0 grams of paratoluene sulfonic acid. Heat to 120–150 degrees C. using a nitrogen sparge. Water will begin to distill off once the temperature reaches 120 degrees C. Once 98% of the theoretical water level is reached proceed into step two-reaction with suitable amines.

Example 3

To 981.8 grams of raw material example 1, having a hydroxyl value of about 11.0 mg KOH/gram add 18.2 grams of monochloroacetic acid, and 1.0 grams of paratoluene sulfonic acid. Heat to 120–150 degrees C. using a nitrogen sparge. Water will begin to distill off once the temperature reaches 120 degrees C. Once 98% of the theoretical water level is reached proceed into step two-reaction with suitable amines.

Example 4

To 955.6 grams of the block polymer raw material example 3 add 35.0 grams of monochloroacetic acid, and 1.0 grams of paratoluene sulfonic acid. Heat to 120–150 degrees C. using a nitrogen sparge. Water will begin to distill off once the temperature reaches 120 degrees C. Once 98% of the theoretical water level is reached proceed into step two-reaction with suitable amines.

Example 5

To 1001.4 grams of the product described in the raw material example 1, add 31.9 grams of monochloroacetic acid, and 1.0 grams of paratoluene sulfonic acid. Heat to 120–150 degrees C. using a nitrogen sparge. Water will begin to distill off once the temperature reaches 120 degrees C. Once 98% of the theorteical water level is reached proceed into step two-reaction with suitable amines.

Example 6

To 922.6 grams of the product described in raw material example 4, add 15.3 grams monochloroacetic acid, and 1.0 grams of paratoluene sulfonic acid. Heat to 120–150 degrees C. using a nitrogen sparge. Water will begin to distill off once the temperature reaches 120 degrees C. Once 98% of the theoretical water level is reached proceed into step two-reaction with suitable amines.

Example 7

To 1004.7 grams of the product described in raw material example 5 add 27.6 grams of monochloroacetic acid, and 1.0 grams of paratoluene sulfonic acid. Heat to 120–150 degrees C. using a nitrogen sparge. Water will begin to distill off once the temperature reaches 120 degrees C. Once 98% of the theoretical water level is reached proceed into step two-reaction with suitable amines.

PREPARATION OF THE QUATARNARY

The products which are the subject of this invention are made by reacting the organo-halogen ester prepared above with a suitable amine.

Example 8

To 851.4 grams of the product of example 1, add 149.8 grams of N,N-bis-[2-(2-heptadecyl-2-imidazolin-1-yl)-ethyl]-octadecamide (RNP #97156-59-7). Heat to 150–160 degrees C. Hold temperature and monitor the inorganic chloride levels. When the levels approach theoretical the desired product is obtained.

Example 9

To 861.7 grams of the product of example 2, add 137.6 grams of N,N-bis-[2-(2-heptadecyl-2-imidazolin-1-yl)-ethyl]-octadecamide (RNP #97156-59-7). Heat to 150–160 degrees C. Hold temperature and monitor the inorganic chloride levels. When the levels approach theoretical the desired product is obtained.

Example 10

To 829.6 grams of the product of example 1, add 169.9 grams of N,N-bis-[2-(2-heptadecyl-2-imidazolin-1-yl)-ethyl]-octadecamide (RNP #97156-59-7). Heat to 150–160 degrees C. Hold temperature and monitor the inorganic chloride levels. When the levels approach theoretical the desired product is obtained.

Example 11

To 901.1 grams of the product of example 3, add 100.7 grams of N,N-bis-[2-(2-heptadecyl-2-imidazolin-1-yl)-ethyl]-octadecamide (RNP #97156-59-7). Heat to 150–160 degrees C. Hold temperature and monitor the inorganic chloride levels. When the levels approach theoretical the desired product is obtained.

Example 12

To 831.9 grams of the product of example 1, add 169.6 grams of 1-hydroxyethyl-2-stearyl-imidazoline. Heat to 150–160 degrees C. Hold temperature and monitor the inorganic chloride levels. When the levels approach theoretical the desired product is obtained.

Example 13

To 849.6 grams of the product of example 4, add 150.1 grams of N,N-bis-[2-(2-heptadecyl-2-imidazolin-1-yl)-ethyl]-octadecamide (RNP #97156-59-7). Heat to 150–160 degrees C. Hold temperature and monitor the inorganic chloride levels. When the levels approach theoretical the desired product is obtained.

Example 14

To 896.0 grams of the product of example 5, add 104.0 grams of N,N-bis-[2-(2-heptadecyl-2-imidazolin-1-yl)-ethyl]-octadecamide (RNP #97156-59-7). Heat to 150–160 degrees C. Hold temperature and monitor the inorganic chloride levels. When the levels approach theoretical the desired product is obtained.

Example 15

To 892.3 grams of the product of example 6, add 105.7 grams of N,N-bis-[2-(2-heptadecyl-2-imidazolin-1-yl)-ethyl]-octadecamide (RNP #97156-59-7). Heat to 150–160 degrees C. Hold temperature and monitor the inorganic chloride levels. When the levels approach theoretical the desired product is obtained.

Example 16

To 873.6 grams of the product of example 7, add 142.7 grams of N,N-bis-[2-(2-heptadecyl-2-imidazolin-1-yl)-ethyl]-octadecamide (RNP #97156-59-7). Heat to 150–160 degrees C. Hold temperature and monitor the inorganic chloride levels. When the levels approach theoretical the desired product is obtained.

Example 17

To 860.7 grams of the product of example 1, add 134.9 grams of stearylamidopropyldimethylamine. Heat to 150–160 degrees C. Hold temperature and monitor the inorganic chloride levels. When the levels approach theoretical the desired product is obtained.

Example 18

To 883.2 grams of the product of example 1, add 120.4 grams of stearyl-dimethylamine. Heat to 150–160 degrees C. Hold temperature and monitor the inorganic chloride levels. When the levels approach theoretical the desired product is obtained.

Example 19

To 862.7 grams of the product of example 3, add 137.0 grams of 1-hydroxyethyl-2-stearyl-imidazoline. Heat to 150–160 degrees C. Hold temperature and monitor the inorganic chloride levels. When the levels approach theoretical the desired product is obtained.

Example 20

To 865.2 grams of the product of example 7, add 106.7 grams of 1-aminoethyl-2-stearyl-imidazoline. Heat to 150–160 degrees C. Hold temperature and monitor the inorganic chloride levels. When the levels approach theoretical the desired product is obtained.

Example 21

To 887.9 grams of the product of example 7, add 128.7 grams of n-di-decyl-dimethylamine. Heat to 150–160 degrees C. Hold temperature and monitor the inorganic chloride levels. When the levels approach theoretical the desired product is obtained.

Example 22

To 874.3 grams of the product of example 7, add 128.7 grams of cocamidopropyldimethylamine. Heat to 150–160 degrees C. Hold temperature and monitor the inorganic chloride levels. When the levels approach theoretical the desired product is obtained.

APPLICATIONS EXAMPLES

Example 23

A aqueous solution containing 0.1 to 1.0% active of compound in example #8 is applied to a cotton polyester blend by exhaustion or using conventional dip and nip technology. The material acts as a lubricant for the processing of the fiber and a non-yellowing softener and soil release agent.

Example 24

A solution of 0.25–1.50% active of compound of example #11 is applied to a polyester blend by exhaustion or using conventional dip and nip technology. The material acts as a lubricant for the processing of the fiber and a non-yellowing softener, oil scavenger and soil release.

Example 25

A solution of 1–5% active of one of the novel quaternary compounds examples 17–22 is applied to the rinse cycle of in a laundry application. The product gives excellent softness, hand, and soil release properties.

What is claimed:

1. A compound which is the poly quaternary salt of a reaction product of an alkylene oxide and an aromatic polycarboxylic acid wherein the reaction product contains a terminal ester group of a halogenated monocarboxylic acid.

2. The compound of claim 1 wherein the halogenated monocarboxylic acid is a halogenated acetic acid.

3. The compound of claim 1 wherein the polycarboxylic acid is a dicarboxylic acid.

4. The compound of claim 1 wherein the alkylene oxide is ethylene oxide.

5. The compound of claim 1 containing from 5 to 300 moles of alkylene oxide per mole of the polyquaternary salt.

6. The compound of claim 1 wherein the poly quaternary salt contains two quaternary groups.

7. The compound of claim 1 wherein the poly quaternary is formed at least in part by an imidazoline structure.

8. The compound of claim 1 wherein the cationic portion of the polyquaternary is formed at least in part by a mononitrogen containing compound having at least one aliphatic group of 6 or more carbon atoms.

9. The compound of claim 1 wherein the polycarboxylic acid is a phthalic acid.

10. The compound of claim 1 wherein the halogenated monocarboxylic acid is monochloroacetic acid.

11. The compound of claim 1 wherein the polycarboxylic acid contains a sulfonate group.

12. The compound of claim 11 wherein the sulfonate group is pendant from an aromatic ring and is an alkali metal sulfonate.

13. The compound of claim 1 wherein the alkylene oxide is a mixture of ethylene oxide and propylene oxide.

14. The compound of claim 1 and a surfactant.

15. The compound of claim 14 wherein the surfactant is a non-ionic surfactant.

* * * * *